US010414581B2

(12) United States Patent
Chiu

(10) Patent No.: US 10,414,581 B2
(45) Date of Patent: Sep. 17, 2019

(54) PACKING STRAP CARRYING CASE

(71) Applicant: Pin-Yu Chiu, Taichung (TW)

(72) Inventor: Pin-Yu Chiu, Taichung (TW)

( * ) Notice: Subject to any disclaimer, the term of this patent is extended or adjusted under 35 U.S.C. 154(b) by 569 days.

(21) Appl. No.: 14/959,930

(22) Filed: Dec. 4, 2015

(65) Prior Publication Data

US 2017/0158420 A1 Jun. 8, 2017

(51) Int. Cl.

| | |
|---|---|
| ***B65D 85/671*** | (2006.01) |
| ***B65D 25/28*** | (2006.01) |
| ***B65D 25/10*** | (2006.01) |
| ***B65H 49/32*** | (2006.01) |
| ***B65D 85/672*** | (2006.01) |
| ***B65H 75/30*** | (2006.01) |

(52) U.S. Cl.

CPC ..... *B65D 85/671* (2013.01); *B65D 25/108* (2013.01); *B65D 25/2802* (2013.01); *B65D 85/672* (2013.01); *B65H 49/322* (2013.01); *B65H 75/30* (2013.01); *B65H 2701/375* (2013.01)

(58) Field of Classification Search

CPC ..... B65D 85/671; B65D 25/2802; B65D 25/108; B65D 85/672; B65D 85/67; B65H 49/322; B65H 2701/375

USPC ..... 206/303, 403, 389, 398, 397, 404–405, 206/408, 493, 310, 388, 565; 220/4.22, 220/212.5

See application file for complete search history.

(56) References Cited

U.S. PATENT DOCUMENTS 3,102,671 A * 9/1963 Gershen ..... B65C 11/00 225/43
3,612,233 A * 10/1971 Nagpal ..... G03B 21/323 190/117
D255,730 S * 7/1980 McLean ..... D3/315
4,846,343 A * 7/1989 Rupert ..... B65D 85/04 206/303
5,205,412 A * 4/1993 Krieg ..... B65D 5/5097 206/394
5,226,610 A * 7/1993 Urlik ..... G03B 21/32 206/398
6,145,780 A * 11/2000 Fontana ..... B65H 49/24 242/400
6,260,704 B1 * 7/2001 Jansen ..... B65D 21/0204 206/226
7,063,285 B1 * 6/2006 Turley ..... B29C 64/106 242/171

(Continued)

*Primary Examiner* — Robert Poon
(74) *Attorney, Agent, or Firm* — Sinorica, LLC

(57) ABSTRACT

A packing strap carrying case includes a casing. The casing has a bottom wall and a side wall. The bottom wall is provided with a plurality of first engaging members. A top edge of the side wall is provided with a plurality of second engaging members. The top edge of the side wall is provided with a connecting portion. A cover is connected with the casing through the connecting portion. A central portion of the cover is provided with a positioning sleeve. The circumferential edge of the positioning sleeve is provided with a plurality of third engaging members corresponding to the first engaging members. The circumferential edge of the cover is provided with fourth engaging members corresponding to the second engaging members. The packing strap can be replaced with ease by the user, and the packing strap can be positioned in the case easily, without consideration of slide.

10 Claims, 13 Drawing Sheets

(56) References Cited

U.S. PATENT DOCUMENTS

| | | | | |
|---|---|---|---|---|
| 8,052,078 | B2 * | 11/2011 | DeLuca | B65H 49/327<br>242/170 |
| 2005/0263640 | A1 * | 12/2005 | Vanderslice | B65D 85/672<br>242/588.3 |
| 2011/0240791 | A1 * | 10/2011 | Lindley | B65H 75/14<br>242/609 |
| 2012/0091249 | A1 * | 4/2012 | Crossett | B65H 49/322<br>242/580 |
| 2014/0077023 | A1 * | 3/2014 | Foreman | B65H 35/002<br>242/588.3 |

* cited by examiner

PACKING STRAP CARRYING CASE

BACKGROUND OF THE INVENTION

1. Field of the Invention

The present invention relates to a packing strap application device, and more particularly to a packing strap carrying case.

2. Description of the Prior Art

A packing strap carrying case is a hollow case formed by injection. The side wall of the case is provided with a flip cover for a roll of packing strap to be placed in the case. However, it is not easy to replace the roll of packing strap in the case through the flip cover of the side wall, and the roll of packing strap cannot be positioned exactly. As a result, when the packing strap is applied, the roll of packing strap may slide in the case. It is difficult to apply the roll of packing strap, and the roll of packing strap may slide out of the case.

Furthermore, male and female molds and a core member are required to form an injection space when the packing strap carrying case is manufactured. The packing strap carrying case is formed by means of the injection space. After that, the molds are demoulded and the core member is taken out, such that the product of the packing strap carrying case is completed. The manufacture procedures of the packing strap carrying case are complicated and not easy.

Accordingly, the inventor of the present invention has devoted himself based on his many years of practical experiences to solve this problem.

SUMMARY OF THE INVENTION

The primary object of the present invention is to provide a packing strap carrying case which is formed easily and manufactured simply to enhance economic benefits. The packing strap can be replaced with ease by the user, and the packing strap can be positioned in the case easily, without consideration of slide.

In order to achieve the aforesaid object, the packing strap carrying case of the present invention comprises a casing and a cover. The casing has a bottom wall and a side wall around the bottom wall. The bottom wall of the casing is provided with a plurality of first engaging members. A top edge of the side wall is provided with a plurality of second engaging members. The top edge of the side wall is provided with a connecting portion. The cover is connected with the casing through the connecting portion. A central portion of the cover is provided with a positioning sleeve. The circumference of the positioning sleeve is provided with a plurality of third engaging members corresponding to the first engaging members. A circumferential edge of the cover is provided with fourth engaging members corresponding to the second engaging members. The cover is provided with a handle.

The cover and the casing of the packing strap carrying case of the present invention can be folded for the user to fit a roll of packing strap on the positioning sleeve directly. The roll of packing strap is positioned by the positioning sleeve. The cover and the casing are buckled, such that the cover and the casing are engaged with each other through the engaging members and the roll of packing strap is positioned in the casing. When the user wants to replace or take out the roll of packing strap, the engaging members are disengaged from each other. The cover and the casing are opened, and the user can take out the roll of packing strap for replacement. The roll of packing strap can be easily positioned and secured in the casing, without consideration of slide. The packing strap carrying case can be formed by injection with male and female molds, without using a core member to form the accommodation space of the casing. The packing strap carrying case can be formed easily. The production procedure can be simplified to enhance economic benefits.

DETAILED DESCRIPTION OF THE PREFERRED EMBODIMENTS

Embodiments of the present invention will now be described, by way of example only, with reference to the accompanying drawings.

Figure 1:
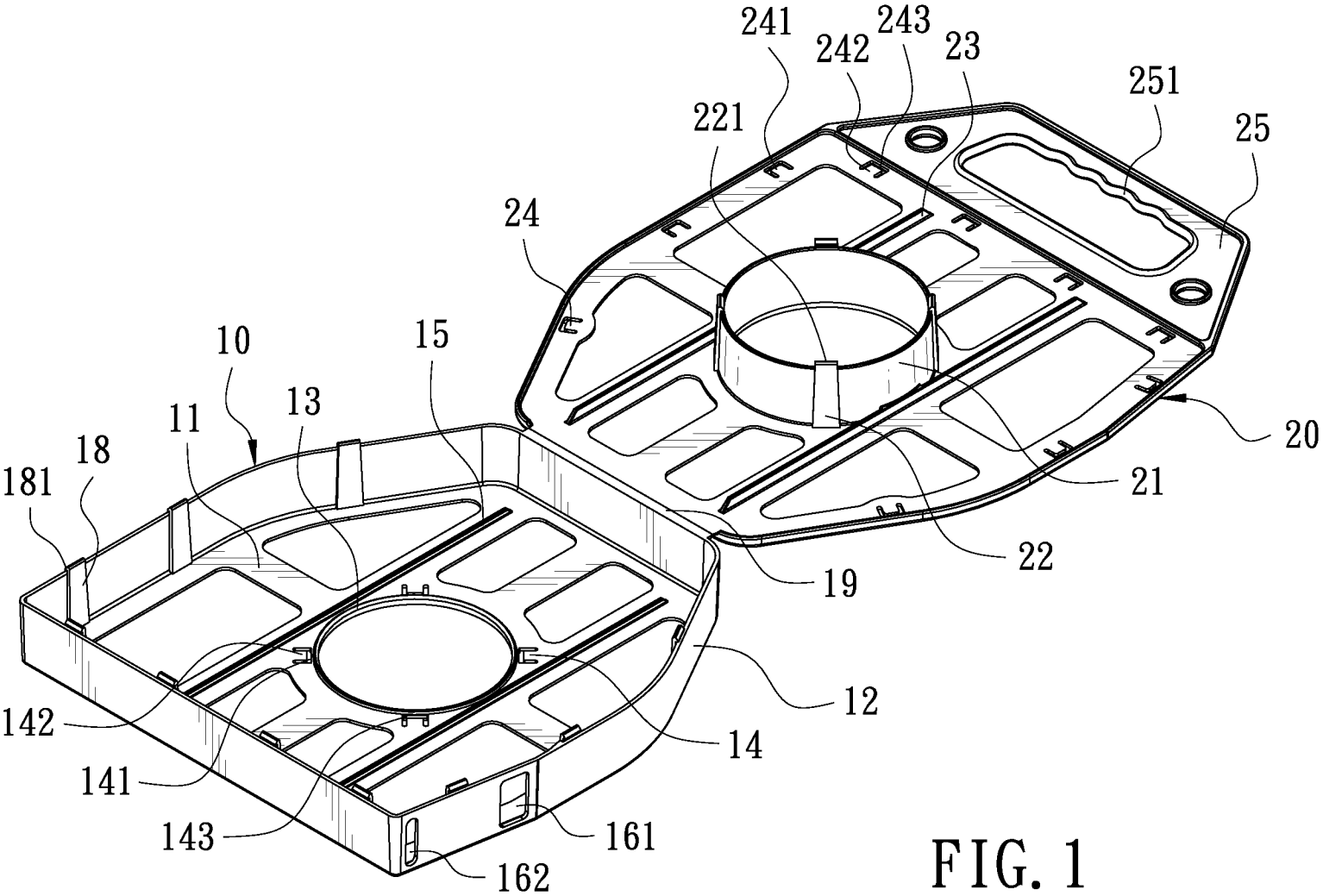
FIG. 1 is a perspective view according to a first embodiment of the present invention.
Figure 2:
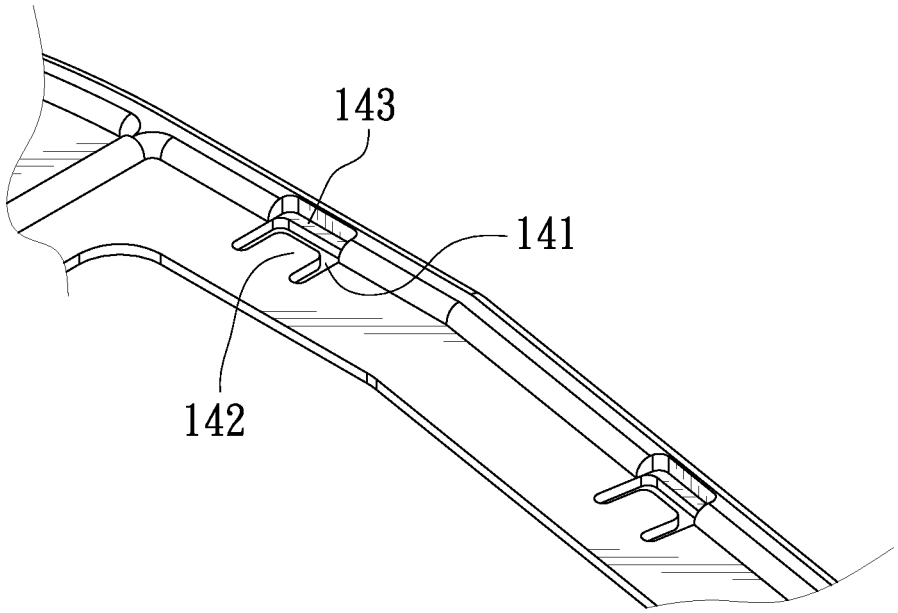
FIG. 2 is a partial perspective view of the first embodiment of the present invention.
Figure 3:
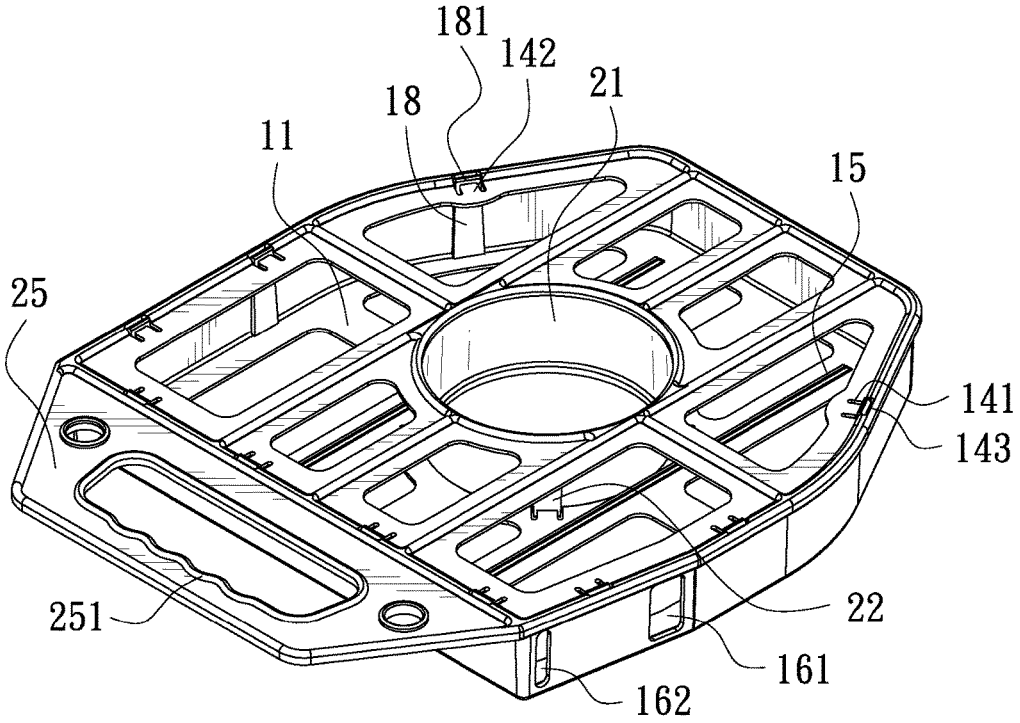
FIG. 3 is a perspective view of the first embodiment of the present invention in a buckled state.

FIG. 1 is a perspective view according to a first embodiment of the present invention. FIG. 2 is a partial perspective view of the first embodiment of the present invention. FIG. 3 is a perspective view of the first embodiment of the present invention in a buckled state. The present invention discloses a packing strap carrying case. The packing strap carrying case comprises a casing 10 and a cover 20.

The casing 10 has a bottom wall 11 and a side wall 12 around the bottom wall 11. A central portion of the bottom wall 11 is provided with a positioning ring 13. The casing 10 is provided with a plurality of first engaging members 14 disposed around the circumference of the positioning ring 13. Each first engaging member 14 has an engaging hole 141. The engaging hole 141 is a U-shaped hole, such that each first engaging member 14 is formed with an engaging piece 142 through the engaging hole 141. Each first engaging member 14 is formed with an engaging recess 143 opposite the engaging piece 142. The bottom wall 11 is provided with a plurality of first raised ribs 15. The side wall 12 is formed with a strap outlet 161 and an insertion inlet 162. A top edge of the side wall 12 is provided with a plurality of second engaging members 18. Each second engaging member 18 is provided with an engaging hook 181. The top edge of the side wall 12 is provided with a flaky connecting portion 19.

The cover 20 is connected with the casing 10 through the connecting portion 19. A central portion of the cover 20 is provided with a positioning sleeve 21 corresponding to the positioning ring 13. The circumferential edge of the positioning sleeve 21 is provided with a plurality of third engaging members 22 corresponding to the first engaging members 14. Each third engaging member 22 is provided with an engaging hook 221. The cover 20 is provided with a plurality of second raised ribs 23. The circumferential edge of the cover 20 is provided with fourth engaging members 24 corresponding to the second engaging members 18. Each fourth engaging member 24 has an engaging hole 241. The engaging hole 241 is a U-shaped hole, such that each fourth engaging member 24 is formed with an engaging piece 242 through the engaging hole 241. Each fourth engaging member 24 is formed with an engaging recess 243 opposite the engaging piece 242. The engaging recess 243 corresponds to the engaging hook 221 of the third member 22. The cover 20 is provided with a handle 25. The handle 25 is provided with a wavy portion 251.

Figure 4:
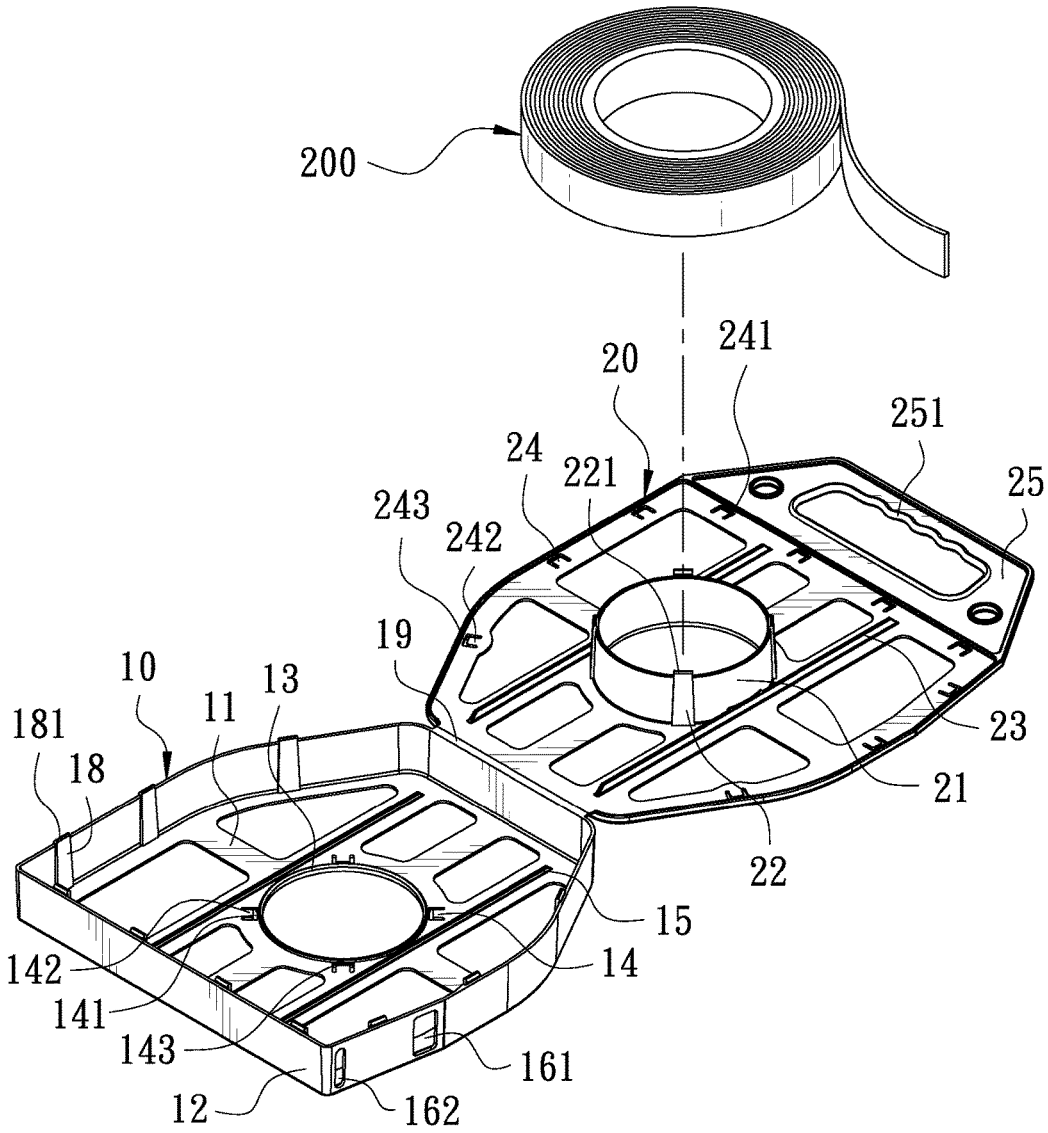
FIG. 4 is a schematic view of the first embodiment of the present invention in cooperation with a roll of packing strap.
Figure 5:
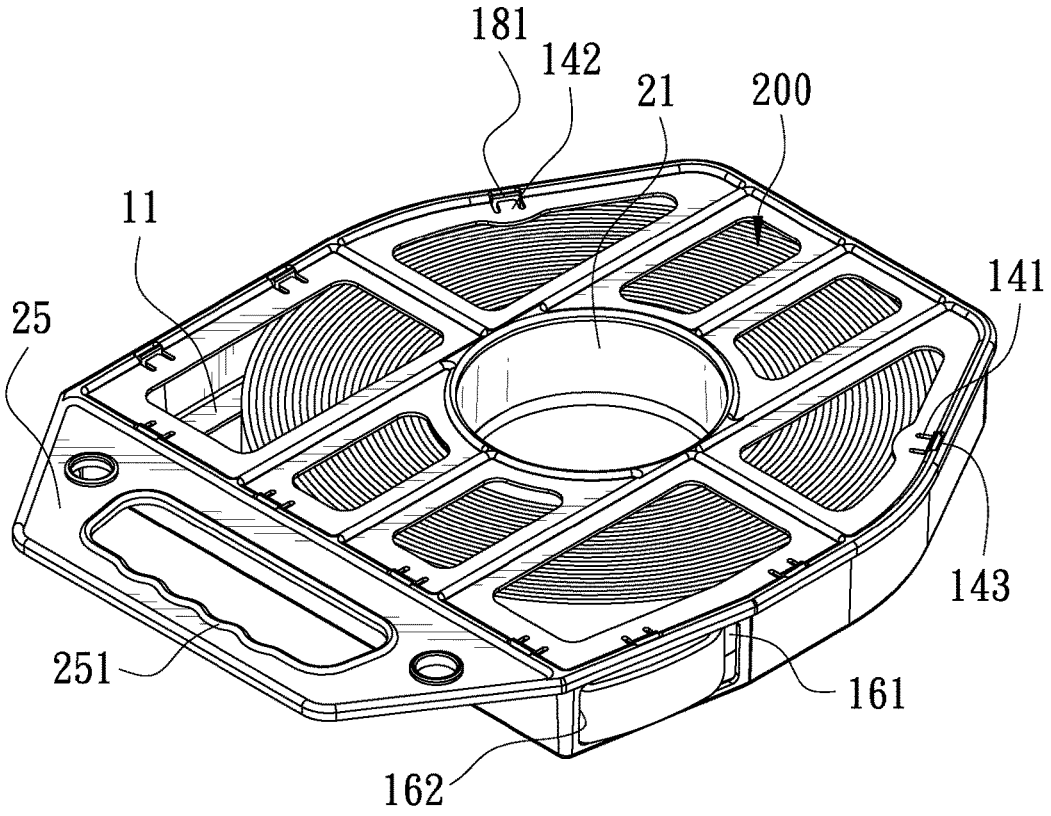
FIG. 5 is a schematic view of the first embodiment of the present invention when in use.

FIG. 4 is a schematic view of the first embodiment of the present invention in cooperation with a packing strap. FIG. 5 is a schematic view of the first embodiment of the present invention when in use. When in use, the cover 20 and the casing 10 are folded, and a roll of packing strap 200 is directly fitted on the positioning sleeve 21. The roll of packing strap 200 is positioned by the positioning sleeve 21. The cover 20 and the casing 10 are buckled, enabling the engaging hooks 221 of the third engaging members 22 to engage with the engaging recesses 143 of the first engaging members 14. The engaging pieces 142 of the first engaging members 14 are adapted to press against the third engaging members 22, such that the first engaging members 14 are engaged with the third engaging members 22 steady. The engaging hooks 181 of the second engaging members 18 are engaged with the engaging recesses 243 of the fourth engaging members 24. The engaging pieces 242 of the fourth engaging members 24 are adapted to press against the second engaging members 18, such that the second engaging members 18 are engaged with the fourth engaging members 24 steady. The cover 20 and the casing 10 are engaged with each other, and the roll of packing strap is positioned in the casing 10. Thereby, when in use, the user holds the handle 25 and the packing strap 200 is pulled out from the strap outlet 161. When not in use, the packing strap 200 can be inserted into the insertion inlet 162.

When the user wants to replace or take out the roll of packing strap 200, the engaging pieces 242 are pressed to disengage from the engaging hooks 181 in a reverse direction so that the second engaging members 18 disengage from the fourth engaging members 24. The engaging pieces 142 are pressed to disengage from the engaging hooks 221 in a reverse direction so that the first engaging members 14 disengage from the third engaging members 22. The cover 20 and the casing 10 are opened, and the user can take out the roll of packing strap 200 for replacement.

It is noted that the roll of packing strap can be easily positioned in the casing 10 through the positioned sleeve 21, without consideration of slide. The packing strap carrying case can be formed by injection with male and female molds, without using a core member to form the accommodation space of the casing 10. The production procedure can be simplified to enhance economic benefits.

The first raised ribs 15 and the second raised ribs 23 of the packing strap carrying case can be in a different height to cooperate with a different width of packing strap. Thereby, when the roll of packing strap 200 is placed in the packing strap carrying case, the first raised ribs 15 and the second raised ribs 23 hold against the roll of packing strap 200.

Figure 6:
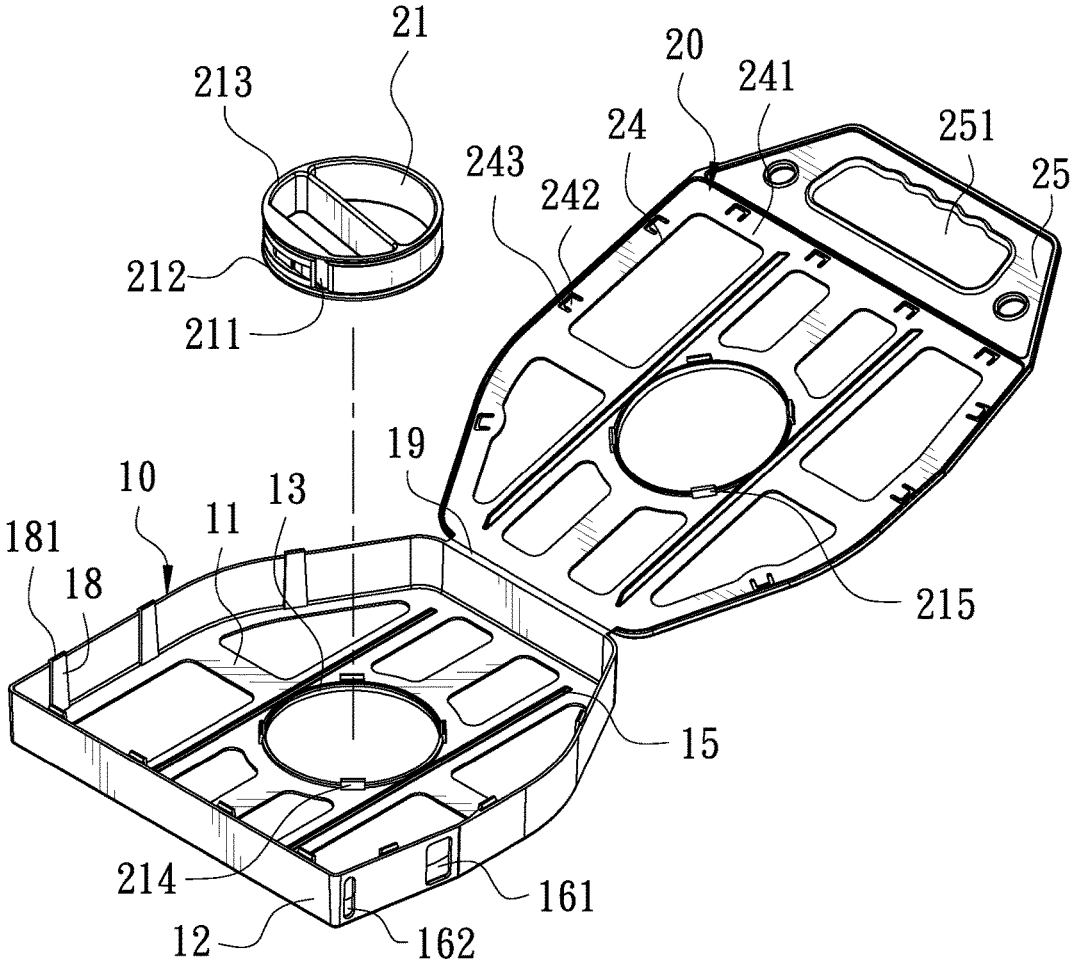
FIG. 6 is an exploded view according to a second embodiment of the present invention.
Figure 7:
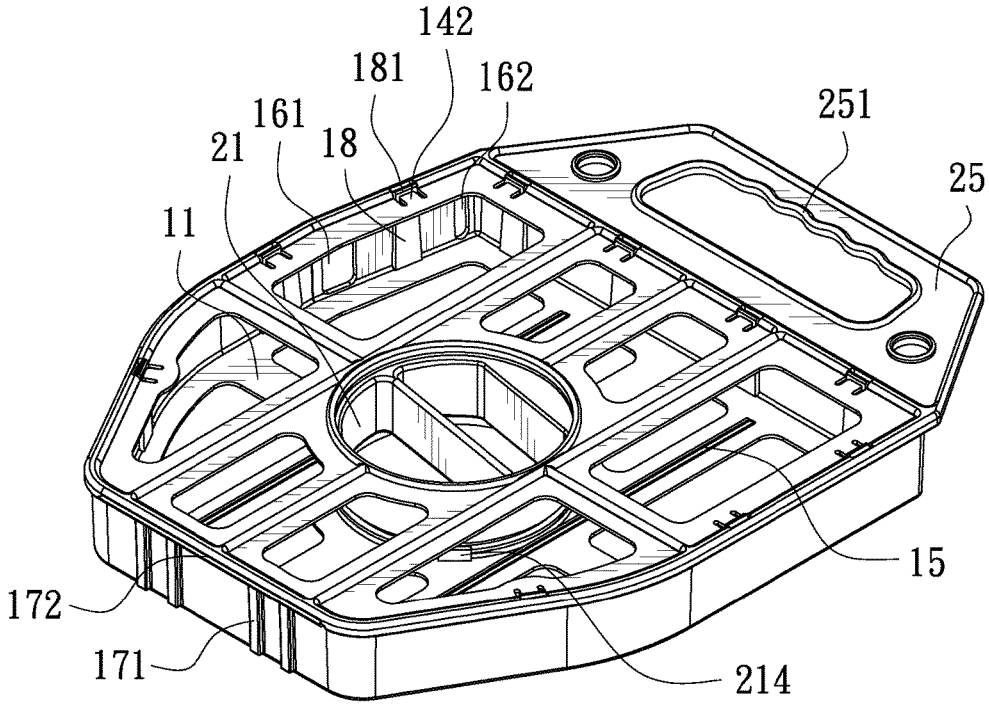
FIG. 7 is a perspective view of the second embodiment of the present invention in a buckled state.
Figure 8:
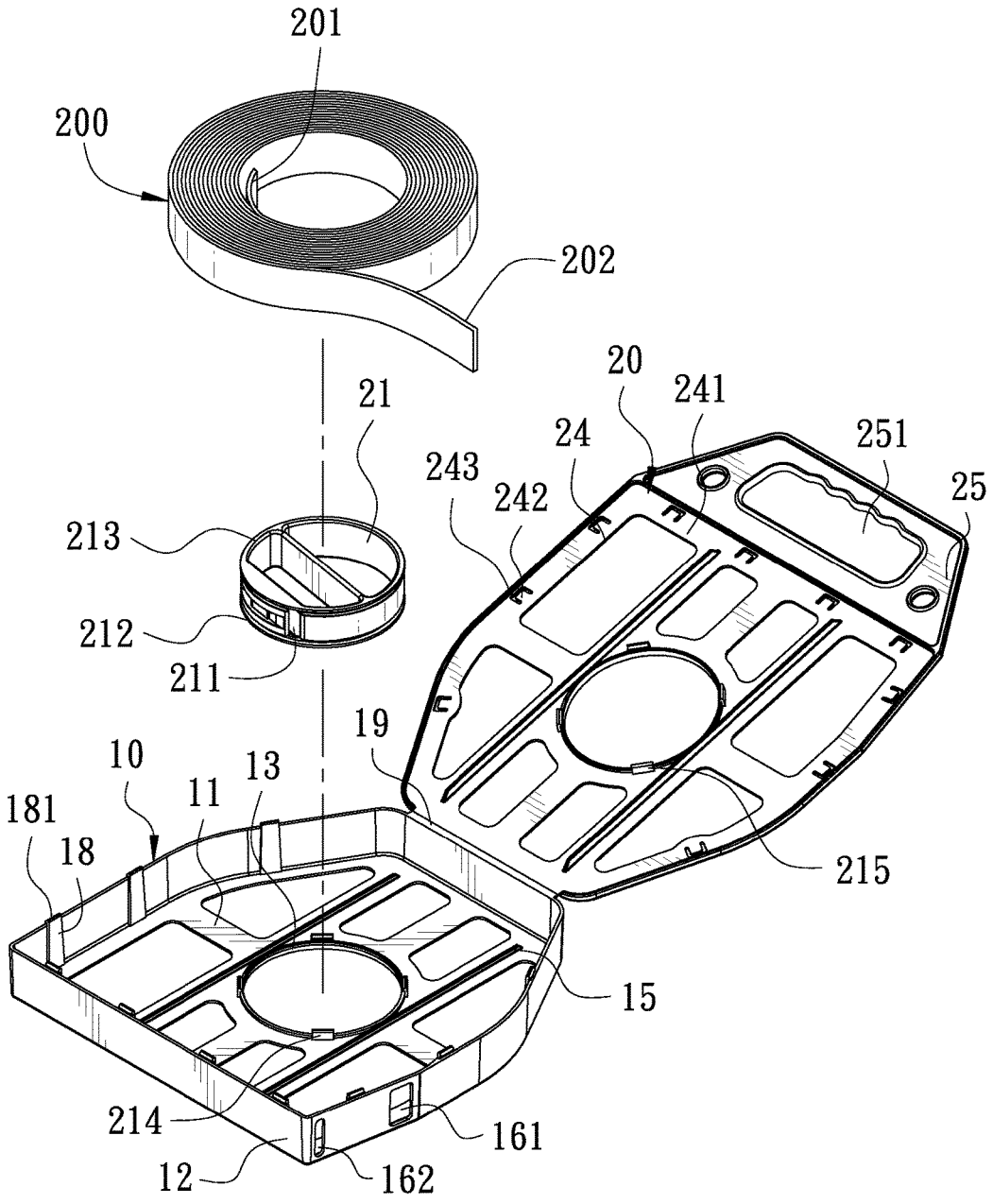
FIG. 8 is a schematic view of the second embodiment of the present invention in cooperation with a roll of packing strap.

FIG. 6 is an exploded view according to a second embodiment of the present invention. FIG. 7 is a perspective view of the second embodiment of the present invention in a buckled state. FIG. 8 is a schematic view of the second embodiment of the present invention in cooperation with a roll of packing strap. The second embodiment is substantially similar to the first embodiment with the exceptions described hereinafter. An outer wall of the positioning sleeve 21 is radially formed with an insertion hole 211. Upper and lower ends of the positioning sleeve 21 are formed with a first engaging groove 212 and a second engaging groove 213. The cover 20 is provided with a plurality of first hooks 214 corresponding to the first engaging groove 212, enabling the first hooks 214 to buckle the first engaging groove 212, such that the positioning sleeve 21 is secured to the cover 20 through the first hooks 214 and the first engaging grove 212. The casing 10 is provided with a plurality of second hooks 215 corresponding to the second engaging groove 213, enabling the second hooks 215 to buckle the second engaging groove 213, such that the positioning sleeve 21 is secured to the casing 10 through the second hooks 215 and the second engaging grove 213. Thereby, the positioning sleeve 21 can be selectively secured to the casing 10 or the cover 20 first, and then the roll of packing strap 200 is mounted. An inner end 201 of the roll of packing strap 200 is engaged in the insertion hole 211. After that, the cover 20 and the casing 10 are buckled together, enabling the positioning sleeve 21 to be secured between the casing 10 and the cover 20. Through the positioning sleeve 21, the roll of the packing strap 200 is positioned and secured in the casing 10, without consideration of slide.

Figure 10:
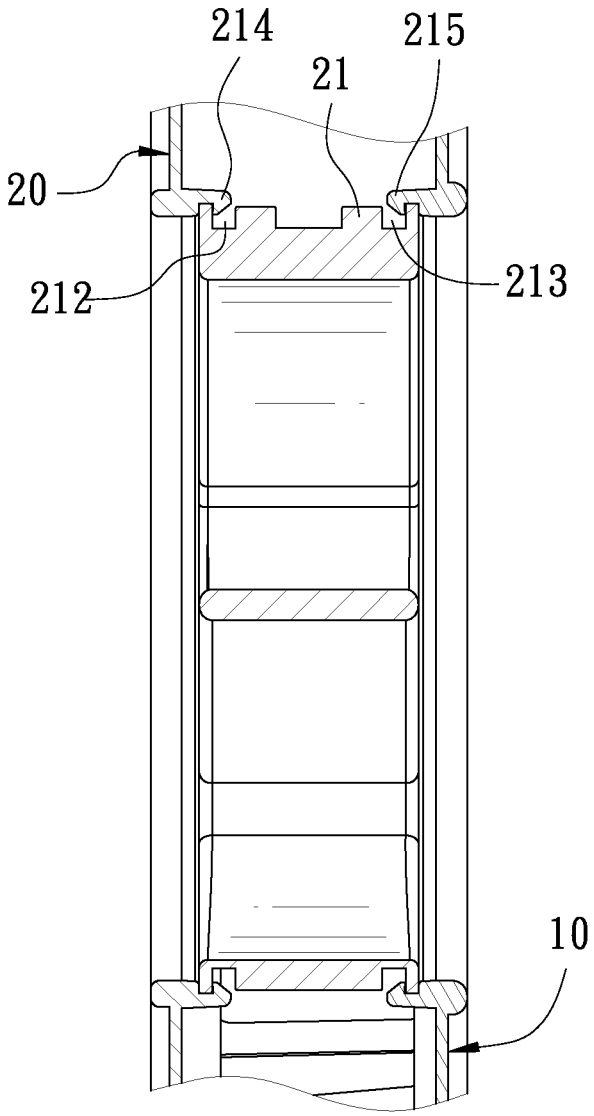
FIG. 10 is a sectional view of the second embodiment of the present invention.

Referring to FIG. 10, the first hooks 214 and the second hooks 215 are to buckle the first engaging groove 212 and the second engaging groove 213 of the positioning sleeve 21, respectively. After the positioning sleeve 21 is secured to the casing 10 and the cover 20, the positioning sleeve 21 is rotatable by means of the first hooks 214 and the second hooks 215 to buckle the first engaging groove 212 and the second engaging groove 213. During rotation, the first hooks 214 and the second hooks 215 are still to buckle the first engaging groove 212 and the second engaging groove 213 of the positioning sleeve 21. When the roll of packing strap 200 is pulled for use, the positioning sleeve 21 is turned along with the roll of packing strap 200 so that the roll of packing strap 200 can be pulled more smoothly.

Figure 9:
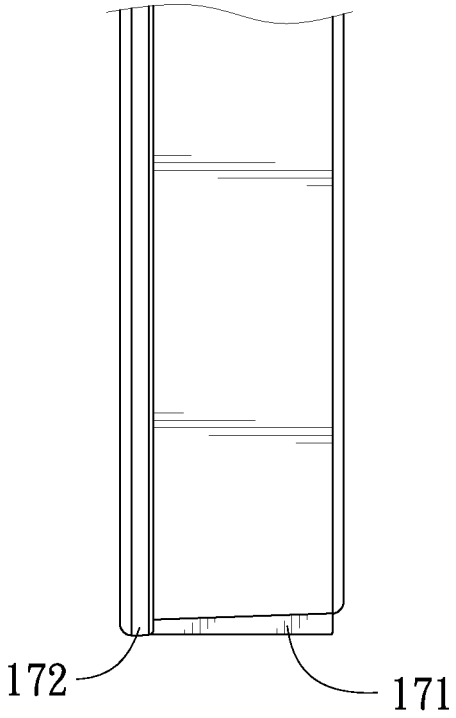
FIG. 9 is a side view of the second embodiment of the present invention, showing that the packing strap carrying case is placed uprightly.

Referring to FIG. 9, the side wall 12 is provided with a plurality of transverse ribs 171 and longitudinal ribs 172 at the position of the connecting portion 19. Thus, the transverse ribs 171 and the longitudinal ribs 172 are to form a crisscross support portion for the packing strap carrying case to be placed uprightly and stably.

Figure 11:
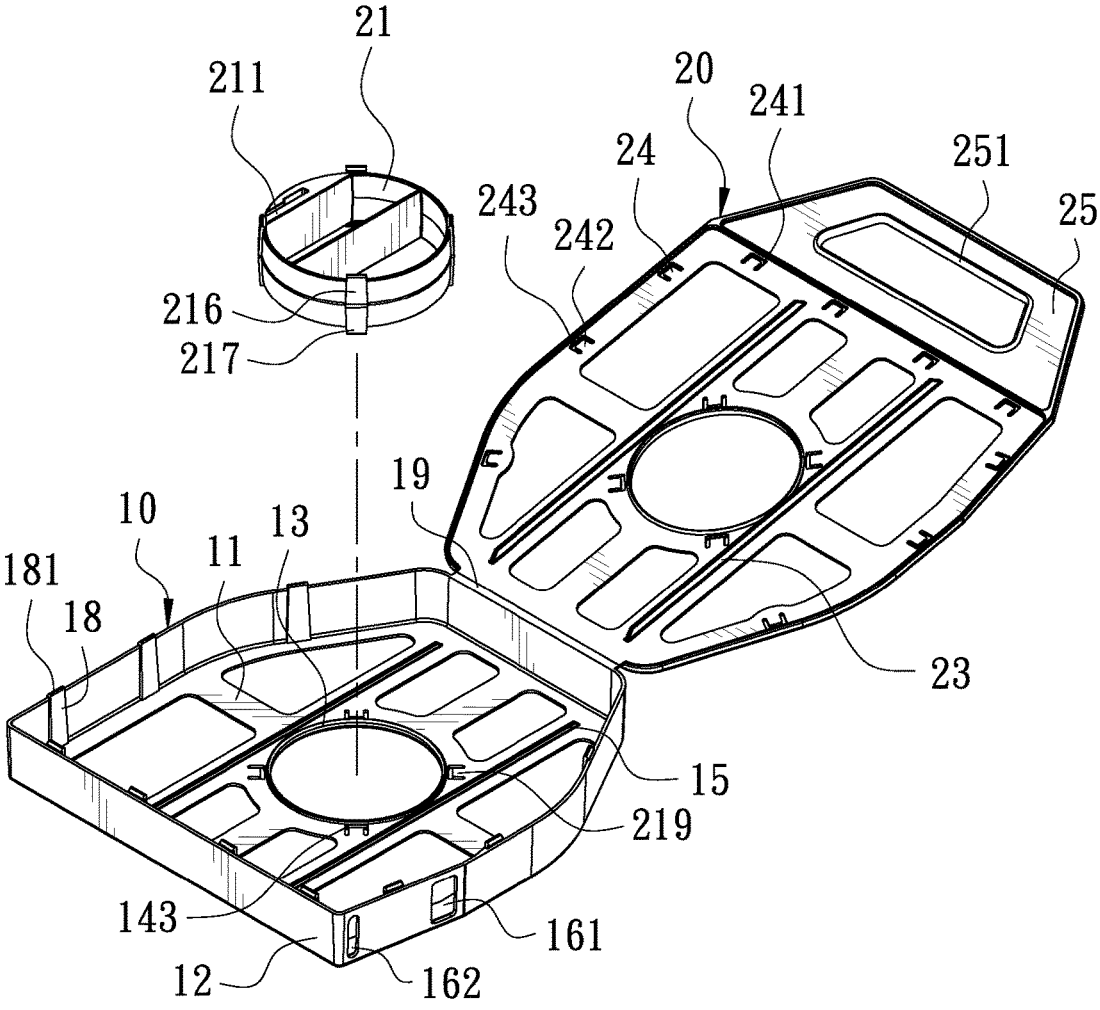
FIG. 11 is an exploded view according to a third embodiment of the present invention.
Figure 12:
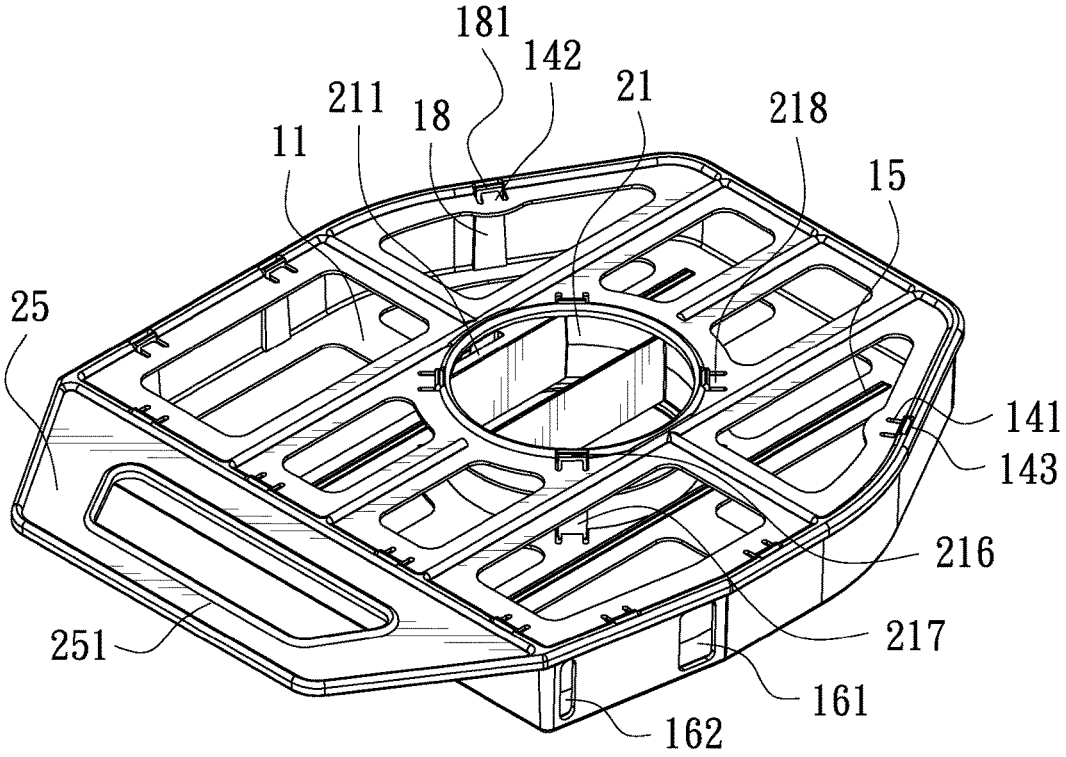
FIG. 12 is a perspective view of the third embodiment of the present invention in a buckled state.
Figure 13:
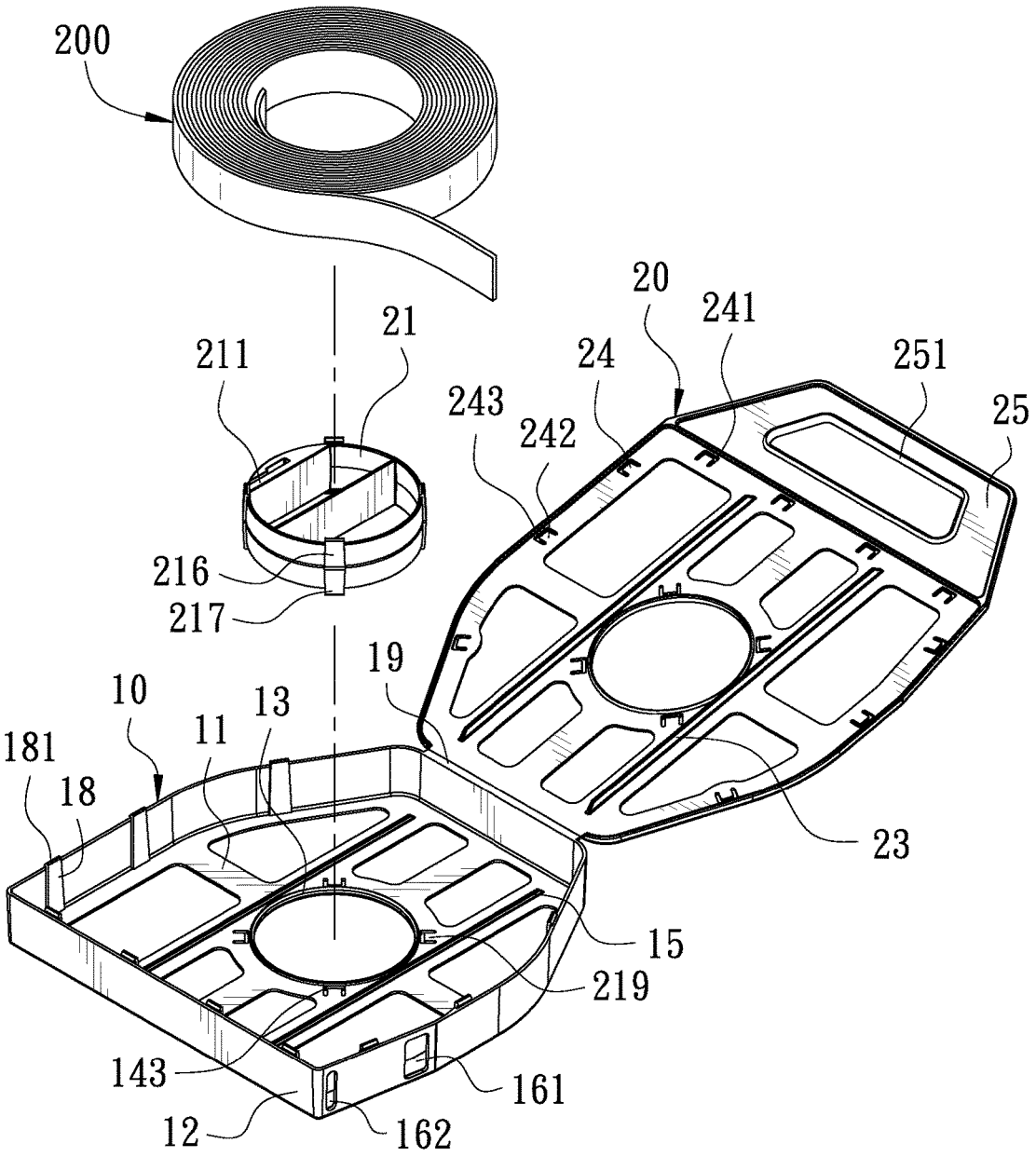
FIG. 13 is a schematic view of the third embodiment of the present invention in cooperation with a roll of packing strap.

FIG. 11 is an exploded view according to a third embodiment of the present invention. FIG. 12 is a perspective view of the third embodiment of the present invention in a buckled state. FIG. 13 is a schematic view of the third embodiment of the present invention in cooperation with a roll of packing strap. The third embodiment is substantially similar to the first embodiment with the exceptions described hereinafter. Upper and lower ends of the positioning sleeve 21 are provided with a plurality of first positioning hooks 216 and second positioning hooks 217. The cover 20 is formed with a plurality of first positioning slots 218 corresponding to the first positioning hooks 216 for the first positioning hooks 216 to engage with the first positioning slots 218. Through the first positioning hooks 216 and the first positioning slots 218, the positioning sleeve 21 is secured to the cover 20. The casing 10 is formed with a plurality of second positioning slots 219 corresponding to the second positioning hooks 217 for the second positioning hooks 217 to engage with the second positioning slots 219. Through the second positioning hooks 217 and the second positioning slots 219, the positioning sleeve 21 is secured to the casing 10. Thereby, the positioning sleeve 21 can be selectively secured to the casing 10 or the cover 20 first, and then the roll of packing strap 200 is mounted. After that, the cover 20 and the casing 10 are buckled together, enabling the positioning sleeve 21 to be secured between the casing 10 and the cover 20. Through the positioning sleeve 21, the roll of the packing strap 200 is positioned and secured in the casing 10, without consideration of slide.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A packing strap carrying case comprising:

a casing;

a cover;

a positioning sleeve;

the casing comprising a bottom wall, a side wall, a plurality of casing engaging members, a connecting portion and a plurality of casing hooks;

the side wall being connected around the bottom wall;

the side wall comprising a top edge;

the plurality of casing engaging members being disposed on the top edge;

the connecting portion being formed on the top edge;

the bottom wall comprising a central casing portion;

the cover being connected with the casing through the connecting portion;

the cover comprising a central cover portion, a circumferential edge, a plurality of cover engaging members and a plurality of cover hooks;

the plurality of cover engaging members being disposed on the circumferential edge;

the plurality of cover engaging members being releasably engaged with the plurality of casing engaging members;

the plurality of cover hooks being connected with the central cover portion;

the plurality of casing hooks being connected with the central casing portion;

the positioning sleeve comprising a circular body, an annular casing engaging groove and an annular cover engaging groove;

the annular casing engaging groove and the annular cover engaging groove each being annularly formed on the circular body;

the annular casing engaging groove and the annular cover engaging groove being oppositely located to each other along the circular body;

the annular casing engaging groove being releasably engaged with the plurality of casing hooks;

the annular cover engaging groove being releasably engaged with the plurality of cover hooks; and the positioning sleeve being capable of rotating with respect to the casing and the cover in response to the plurality of cover engaging members being engaged with the plurality of casing engaging members, the annular casing engaging groove being engaged with the plurality of casing hooks and the annular cover engaging groove being engaged with the plurality of cover hooks.

2. The packing strap carrying case as claimed in claim 1, wherein the casing comprises a plurality of casing raised ribs, the plurality of casing raised ribs are connected with the bottom wall, and the cover comprises a plurality of cover raised ribs.

3. The packing strap carrying case as claimed in claim 1 comprising:

a handle; and the handle being connected with the cover.

4. The packing strap carrying case as claimed in claim 1, wherein the side wall comprises a strap outlet and an insertion inlet.

5. The packing strap carrying case as claimed in claim 1, wherein the casing comprises a plurality of first engaging members and a plurality of second engaging members, the cover comprises a plurality of third engaging members and a plurality of fourth engaging members, each first engaging member has an engaging hole, the engaging hole of each first engaging member is a U-shaped hole, each first engaging member is formed with an engaging piece through the engaging hole of the first engaging member, each first engaging member is formed with an engaging recess opposite the engaging piece of the first engaging member, each second engaging member is provided with an engaging hook, each third engaging member is provided with an engaging hook, each fourth engaging member has an engaging hole, the engaging hole of each fourth engaging member is a U-shaped hole, each fourth engaging member is formed with an engaging piece through the engaging hole of the fourth engaging member, and each fourth engaging member is formed with an engaging recess opposite the engaging piece of the fourth engaging member.

6. The packing strap carrying case as claimed in claim 1, wherein the casing comprises a positioning ring, the positioning ring is connected with the central casing portion, and the positioning ring corresponds to the positioning sleeve.

7. The packing strap carrying case as claimed in claim 1, wherein the bottom wall and the cover are formed with a plurality of positioning slots, and the positioning sleeve is provided with a plurality of positioning hooks corresponding to the positioning slots.

8. The packing strap carrying case as claimed in claim 1, wherein the positioning sleeve comprises an outer wall and an insertion hole, and the insertion hole is radially formed on the outer wall.

9. The packing strap carrying case as claimed in claim 1, wherein the side wall is provided with a plurality of transverse ribs and longitudinal ribs at the position of the connecting portion.

10. The packing strap carrying case as claimed in claim 3, wherein the handle comprises a wavy portion.

* * * * *